US007320419B1

(12) United States Patent
Finamore

(10) Patent No.: US 7,320,419 B1
(45) Date of Patent: Jan. 22, 2008

(54) HANGER WITH ROLLER BEADS

(76) Inventor: Sandro Finamore, 8301 Ridge Blvd. apt. 4F, Brooklyn, NY (US) 11209

( * ) Notice: Subject to any disclaimer, the term of this patent is extended or adjusted under 35 U.S.C. 154(b) by 228 days.

(21) Appl. No.: 11/044,461

(22) Filed: Jan. 27, 2005

(51) Int. Cl.
*A41D 27/22* (2006.01)

(52) U.S. Cl. ..... 223/85; 223/92; 223/95; 223/DIG. 4; 248/302

(58) Field of Classification Search ..... 223/85, 223/92, 95, 97, DIG. 4; 16/87.6 R, 87.8; 248/302, 303; D6/367, 373
See application file for complete search history.

(56) References Cited

U.S. PATENT DOCUMENTS

| | | | | | |
|---|---|---|---|---|---|
| 396,604 | A | * | 1/1889 | Rings | 16/87.8 |
| 460,793 | A | * | 10/1891 | Rings | 16/87.8 |
| 699,507 | A | * | 5/1902 | Erich | 16/87.8 |
| 1,721,338 | A | * | 7/1929 | Gagnon | 16/87.8 |
| 1,857,293 | A | * | 5/1932 | Vroom | 16/87.8 |
| 2,008,471 | A | * | 7/1935 | Schroeder | 160/390 |
| 2,320,003 | A | * | 5/1943 | Madan | 16/87.8 |
| 2,499,188 | A | * | 2/1950 | Freeman | 211/113 |
| 2,538,755 | A | * | 1/1951 | Bradley | 160/341 |
| 2,549,730 | A | * | 4/1951 | Wassarman | 223/85 |
| 2,864,147 | A | * | 12/1958 | Solow | 223/85 |
| D214,107 | S | * | 5/1969 | Hallahan | D8/373 |
| 3,448,902 | A | * | 6/1969 | Stebbins | 223/85 |
| 5,050,833 | A | * | 9/1991 | Usner | 248/340 |
| D350,279 | S | * | 9/1994 | Tate | D8/373 |
| D404,639 | S | * | 1/1999 | Samelson | D8/373 |
| D441,584 | S | * | 5/2001 | Ho | D6/580 |
| 6,530,120 | B2 | * | 3/2003 | Samelson | 16/87.2 |
| D495,591 | S | * | 9/2004 | Clucas | D8/367 |
| D498,662 | S | * | 11/2004 | Neri | D8/373 |
| 2005/0230441 | A1 | * | 10/2005 | Presser et al. | 223/85 |

* cited by examiner

*Primary Examiner*—Gary L. Welch
*Assistant Examiner*—Nathan E Durham
(74) *Attorney, Agent, or Firm*—Michael I Kroll

(57) ABSTRACT

The present invention 10 discloses a clothes hanger 12 having roller beads 14 mounted upon the hook portion 22 of the frame. The present invention 10 comprises a lower wire frame 23 which may take the conventional hanger shape or other shapes or styles with the hook portion 22 having bead-like rollers 14 captive thereon. The hanger rolls with ease along the hanger rod 16 making the task of moving heavy clothing 18, such as coats, easy. The rollers 14 can be constructed from a variety of materials and can be of a variety of colors. The rollers can be held captive to the hook portion of the hanger 12 by a hook-shaped roller stop 24 at one distal end and the wrapping of the wire hanger at the other end 28 or by bonding the first and last bead to the hanger.

4 Claims, 8 Drawing Sheets

HANGER WITH ROLLER BEADS

BACKGROUND OF THE INVENTION

Field of the Invention

The present invention relates generally to clothes hangers and, more specifically, to a clothes hanger roller beads upon the hook portion of the frame. The present invention, an easy to slide clothes hanger consisting of a wire frame in the conventional hanger shape with the hook portion having bead like rollers captive thereon. The hanger rolls with ease along the rod making the task of moving heavy clothing such as coats easy especially for the elderly or physically challenged persons. The rollers can be constructed from a variety of materials and can be of a variety of colors. The rollers can be held captive to the hook portion of the hanger by a hook shaped roller stop at one distal end and the wrapping of the wire hanger at the other end or by bonding the first and last bead to the hanger. The hanger can be of a conventional shape or of other shapes suitable for hanging garments.

While other hangers may be suitable for the purposes for which they were designed, they would not be as suitable for the purposes of the present invention, as hereinafter described. The present invention, an easy to slide clothes hanger consisting of a wire frame in the conventional hanger shape with the hook portion having bead like rollers captive thereon. The hanger rolls with ease along the rod making the task of moving heavy clothing such as coats easy especially for the elderly or physically challenged persons. The rollers can be constructed of a variety of materials and can be of a variety of colors. The rollers can be held captive to the hook portion of the hanger by a hook shaped roller stop at one distal end and the wrapping of the wire hanger at the other end or by bonding the first and last bead to the hanger. The hanger can be of a conventional shape or of other shapes suitable for hanging garments.

SUMMARY OF THE PRESENT INVENTION

The present invention discloses a clothes hanger having roller beads mounted upon the hook portion of the frame. The present invention comprises a wire frame in the conventional hanger shape or other shapes with the hook portion having bead-like rollers captive thereon. The hanger rolls with ease along the hanger rod making the task of moving heavy clothing, such as coats, easy. The rollers can be constructed from a variety of materials and can be of a variety of colors. The rollers can be held captive to the hook portion of the hanger by a hook-shaped roller stop at one distal end and the wrapping of the wire hanger at the other end or by bonding the first and last bead to the hanger. The hanger can be of a conventional shape or of other shapes suitable for hanging garments.

A primary object of the present invention is to provide an easy to slide hanger.

Another object of the present invention is to provide an easy to slide clothes hanger consisting of a wire housing in the conventional hanger shape with the hook portion having bead like rollers captive thereon.

Still yet another object of the present invention is to provide a hanger with rollers mounted to the hook portion of the frame of the hanger.

Another object of the present invention is to provide an easy to slide clothes hanger that elderly and physically challenged persons can manipulate with ease.

Yet another object of the present invention is to provide a hanger with rollers that can be constructed of a variety of materials and can be of a variety of colors.

Still yet another object of the present invention is to prolong the life of wooden rods. Unlike conventional hangers that can "dig" into the wood and cause splinters.

Additional objects of the present invention will appear as the description proceeds.

The present invention overcomes the shortcomings of the prior art by providing an easy to slide clothes hanger consisting of a wire frame in the conventional hanger shape with the hook portion having bead like rollers captive thereon. The hanger rolls with ease along the rod making the task of moving heavy clothing such as coats easy especially for the elderly or physically challenged persons. The rollers can be constructed of a variety of materials and can be of a variety of colors. The rollers are held captive to the hook portion of the hanger by a hook shaped roller stop at one distal end and the wrapping of the wire hanger at the other end or by bonding the first and last bead to the hanger.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
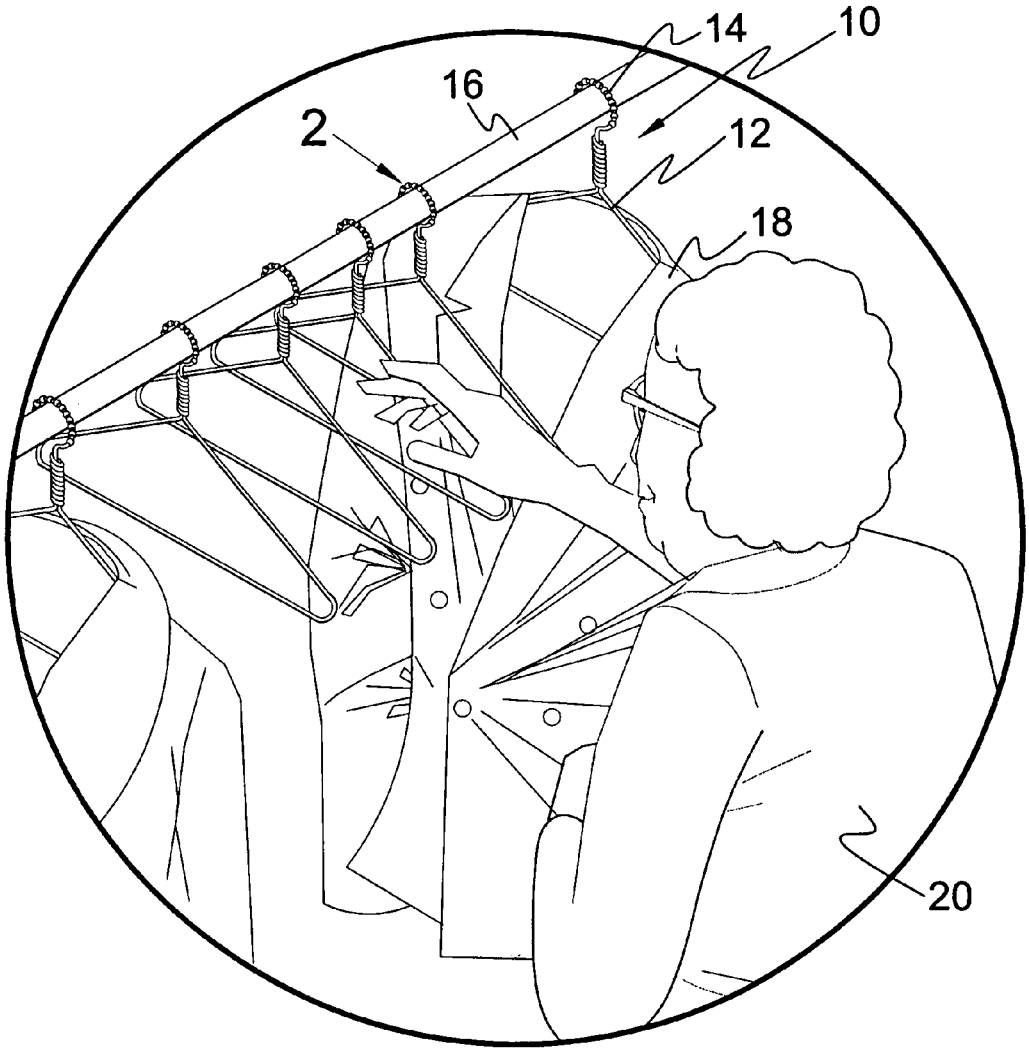
FIG. 1 is an illustrated view of the present invention in use.

With regard to reference numerals used, the following numbering is used throughout the drawings.

10 present invention
12 coat hanger
14 roller
16 bar
18 coat
20 user
22 hook

23 lower frame portion
24 hook end roller stop
26 shank
28 shank roller stop
30 hanger wire
32 throughbore
34 wall
36 arrow

DETAILED DESCRIPTION OF THE PREFERRED EMBODIMENT

The following discussion describes in detail one embodiment of the invention along with one or more alternative embodiments. This discussion should not be construed, however, as limiting the invention to those particular embodiments, since practitioners skilled in the art will recognize numerous other embodiments as well. For a definition of the complete scope of the invention, the reader is directed to the appended claims.

Turning to FIG. 1, shown therein is an illustrated view of the present invention 10 in use by a user 20. The present invention 10 comprises a coat hanger 12 having a plurality of cylindrical-like rollers 14 having a through bore for mounting onto the hook portion of the coat hanger 10 whereby the coat hanger can easily move along the hanger bar 16 especially when heavy objects or clothing such as coats 18 have been mounted on the coat hanger.

Figure 2:
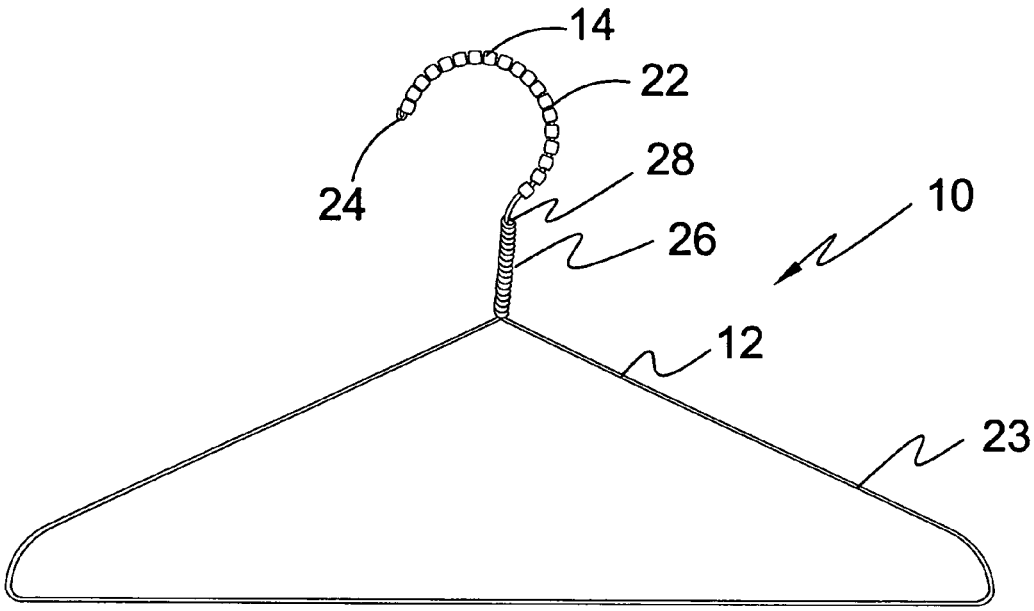
FIG. 2 is a frontal view of the present invention.

Turning to FIG. 2, shown therein is a frontal view of the present invention 10. Shown is a side view of the present invention 10 mounted onto the upper hook portion 22 of a conventional coat hanger 12, the hanger 12 having a lower elongated frame portion 23 for receiving clothes thereon. The lower frame portion 23 is shown being shaped similar to the shoulders of a person for receiving clothing thereon, however, the lower portion could also take other shapes or designs, for example, it could comprise a pair of spring loaded clamps or the like for receiving the legs of a pair trousers thereinbetween the clamps. The plurality of cylindrical-like rollers 14 are freewheeling and will reduce the friction between the hanger bar and hanger hook 22 while the hanger 12 is moving longitudinally along the hanger bar. The rollers 14 can have retaining means on each distal end to prevent the rollers from coming off the hook 22. The retaining means can be by fixedly positioning the first and last roller by bonding them to the hanger or as shown in the illustration, the end or tip of the hanger hook 22 can be bent back onto itself to form a first roller stop 24 while the hook shank 26 can be an enlargement or an enlarged area or wound or wrapped onto itself to form a second roller stop 28. Note that the shank 26 connects the hook 22 to the lower frame portion 23.

Figure 3:
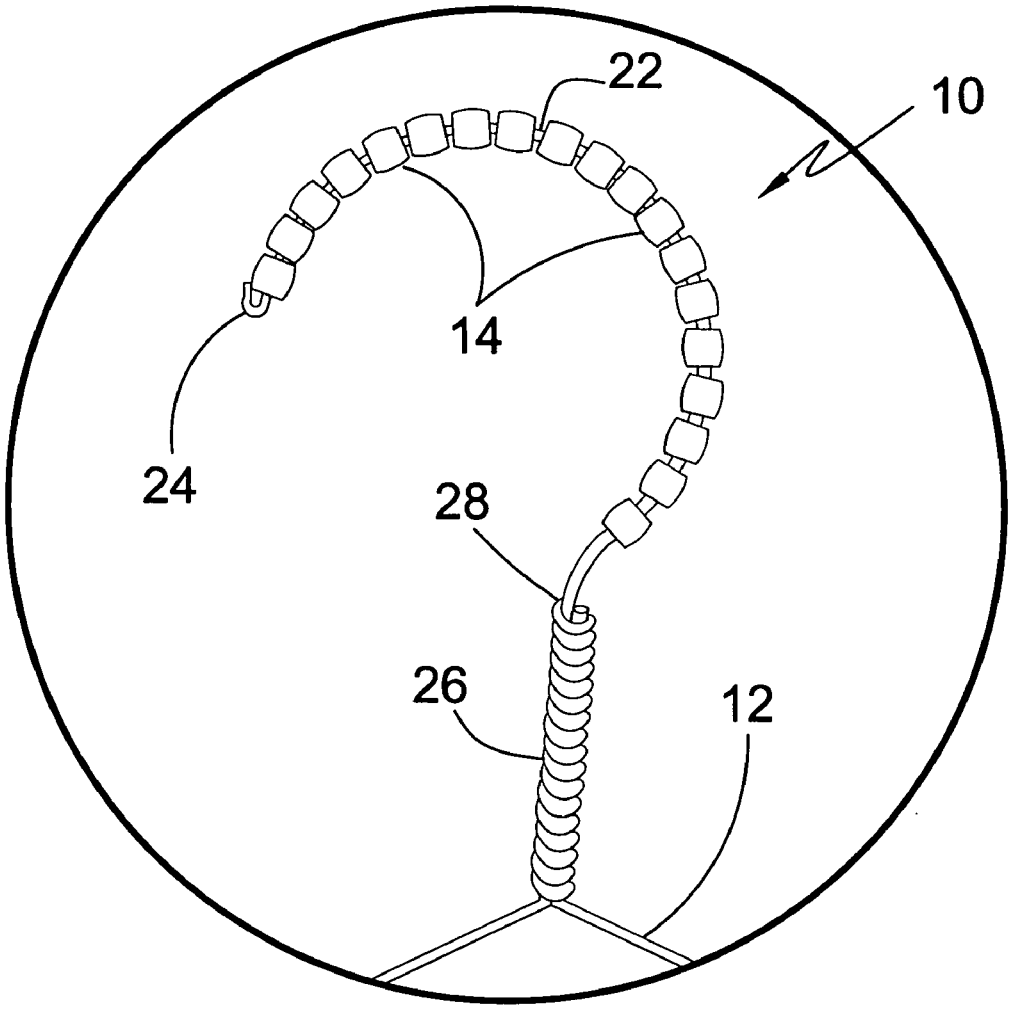
FIG. 3 is a detailed view of the present invention.

Turning to FIG. 3, shown therein is a detailed view of the present invention 10. Shown is an enlarged view of the hook member 22 of the typical coat hanger 12 having the present invention 10, a plurality of cylindrical-like rollers 14 mounted thereon. The modified coat hanger 12 easily slides along the hanger bar when the hanger is moved along the bar because the rollers 14 assist by rolling along the bar without dragging. Items such as heavy coats can be moved along the bar with ease. First roller stop 24 on the hook end is also shown along with an enlarged area 28 on the shank 26 to form a second hook stop 28.

Figure 4:
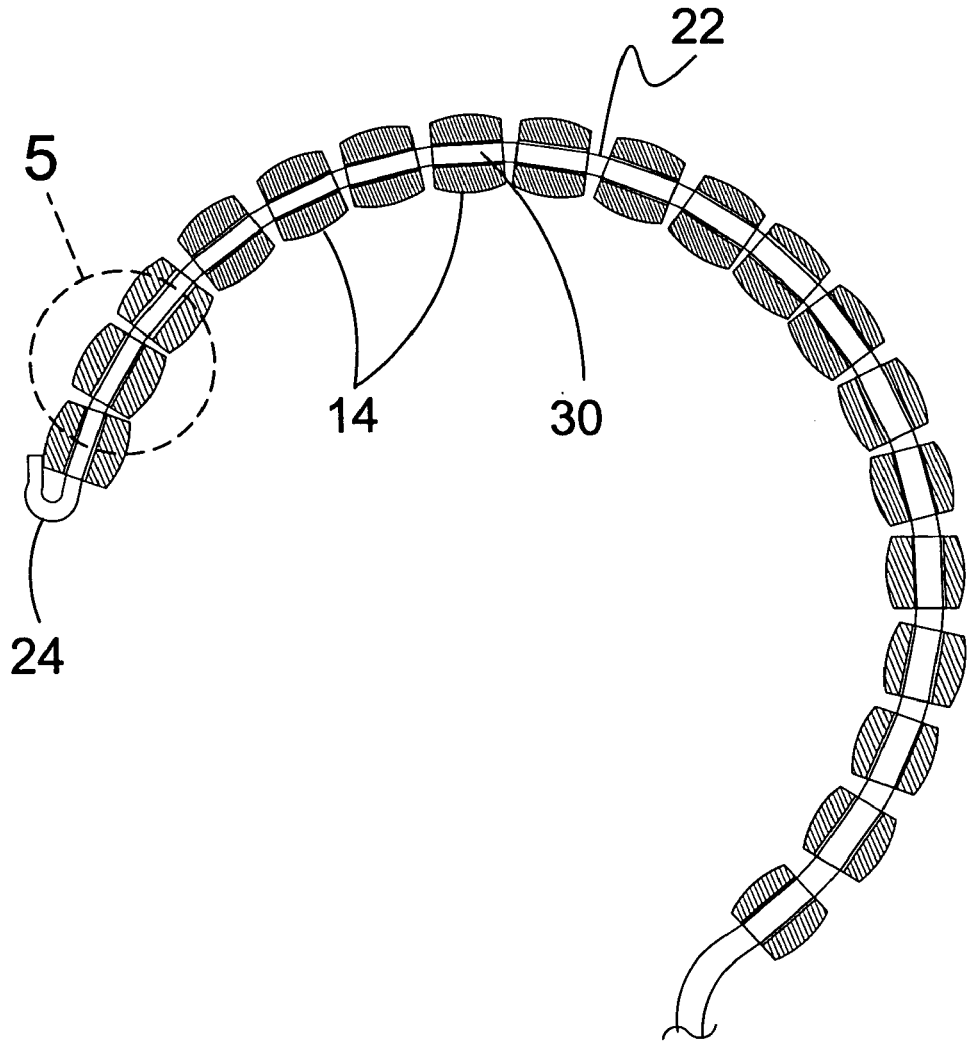
FIG. 4 is a sectional view of the hook portion and rollers of the present invention.

Turning to FIG. 4, shown therein is a sectional view of the hook portion 22 and rollers 14 of the present invention 10. Shown is a sectional view of the hook portion 22 of the hanger having a plurality of rollers 14 positioned thereon. The rollers 14 are substantially cylindrical in shape having a first end and a second end with a throughbore extending therethrough for receiving the hanger wire 30 therein whereby lateral movement of the hanger will cause the rollers 14 to spin thereby reducing drag on the hanger. Roller stop 24 is also shown.

Figure 5:
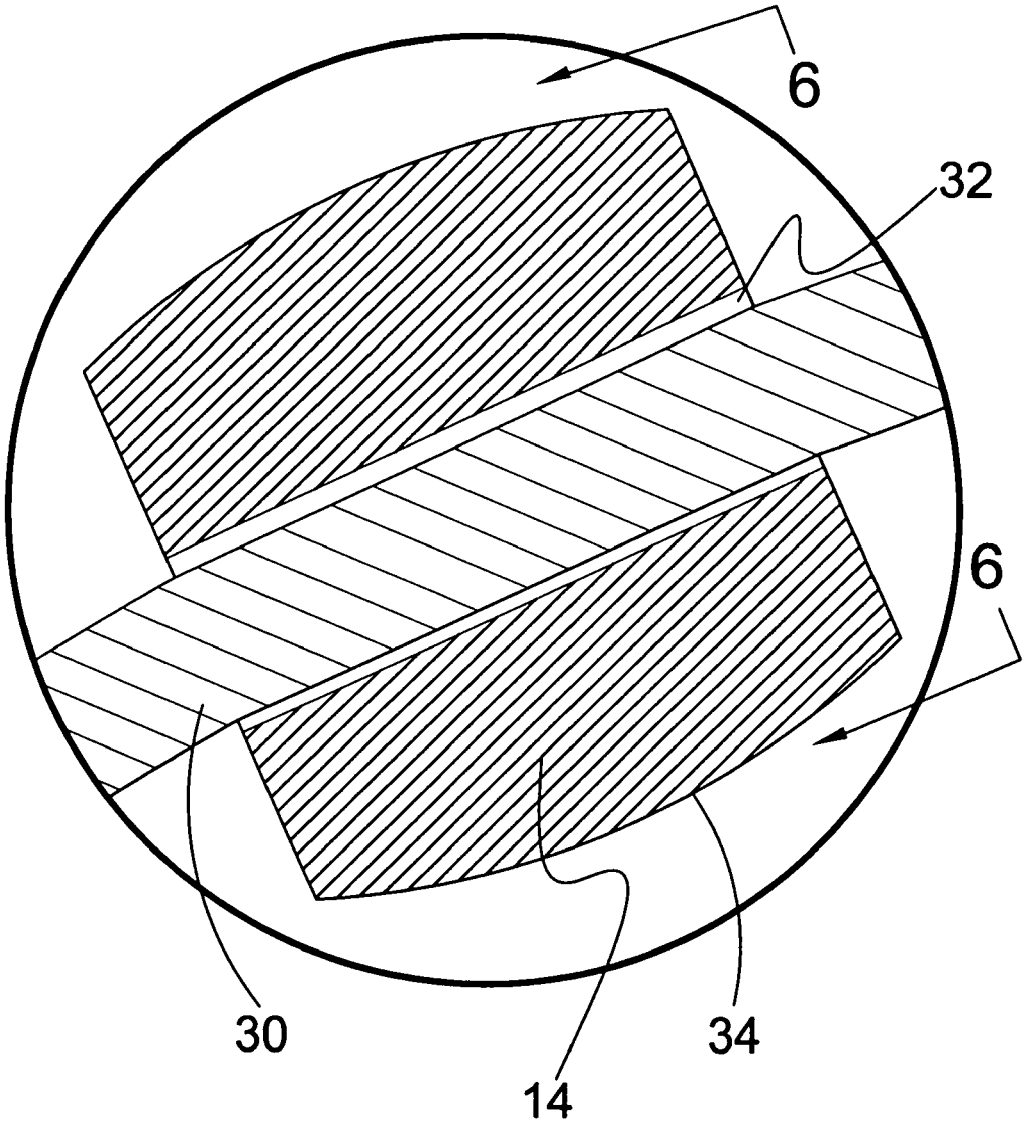
FIG. 5 is an enlarged sectional view of the hook portion and rollers of the present invention.

Turning to FIG. 5, shown therein is an enlarged sectional view showing the roller 14 being substantially cylindrical with opposing planar sides having a throughbore 32 for receiving the end of the hook member hanger wire 30 of the hanger. The outer cylindrical wall 34 of the roller 14 is slightly curved with the apex of the curve centrally positioned. Each one of the plurality of rollers 14 is freewheeling.

Figure 6:
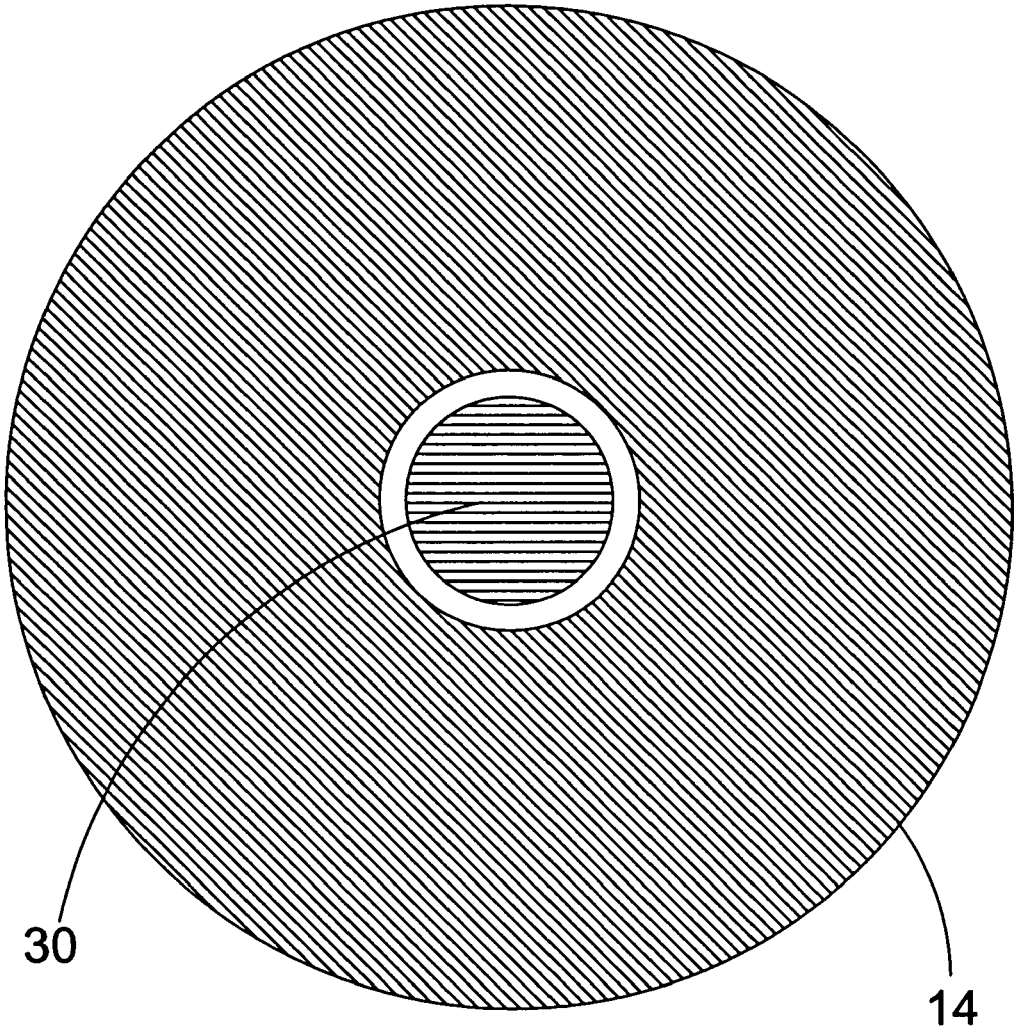
FIG. 6 is a cross sectional view of the hook portion and roller of the present invention.

Turning to FIG. 6, shown therein is a cross sectional view of the hanger wire 30 of the hook portion and roller 14 of the present invention. The bead-like rollers 14 assist the hook portion of the hanger to roll easily along the clothes hanger rod. The housing of the rollers 14 can be constructed from a variety of materials including plastic, wood, ceramic, metal and other materials.

Figure 7:
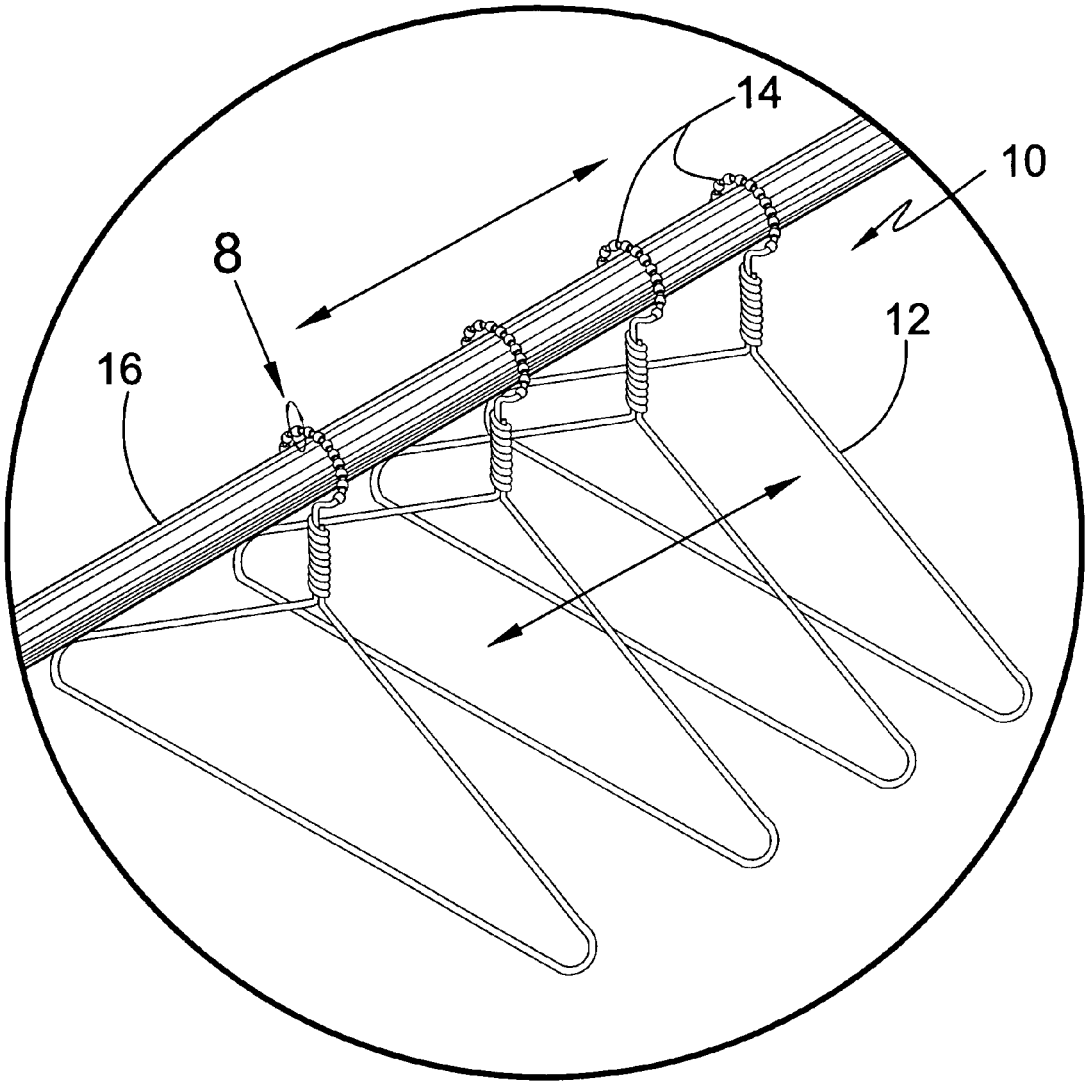
FIG. 7 is a perspective view of the present invention in use.

Turning to FIG. 7, shown therein is a perspective view of the hanger of the present invention 10. Shown is an illustrative view of a plurality of hangers 12 having the hook rollers 14 of the present invention 10 mounted on a hanger bar 16. The bead-like rollers 14 assist the hook portion of the hanger 12 in moving easily along the clothes hanger rod 16 by making it easy to move heavy clothing from one place to another along the rod.

Figure 8:
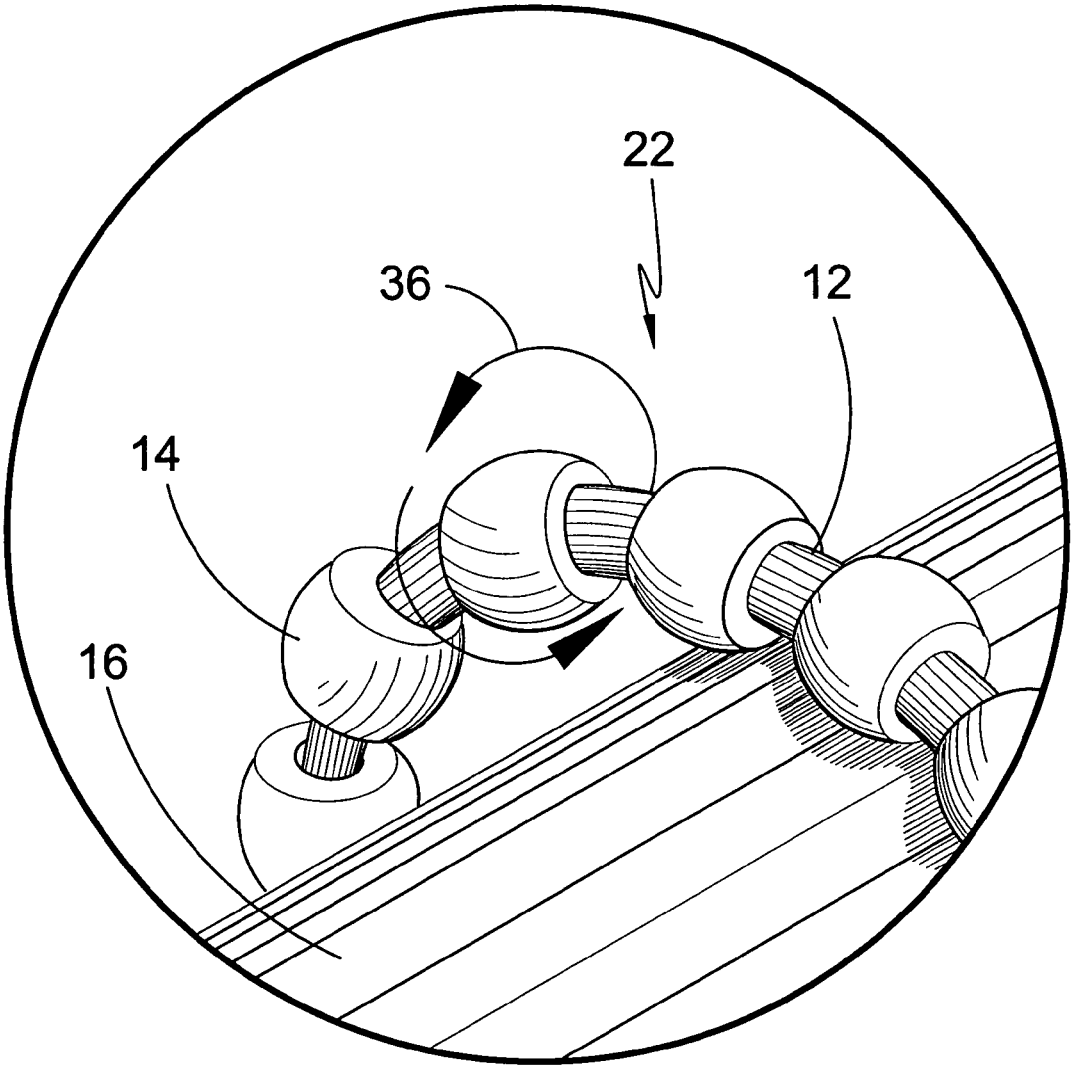
FIG. 8 is a detailed view of the present invention in use.

Turning to FIG. 8, shown therein is a detailed view of the hook portion 22 of hanger 12 of the present invention in use. The present invention is a coat hanger having a plurality of cylindrical-like rollers 14 having a throughbore for mounting onto the hook portion of the coat hanger whereby the coat hanger can easily move along the hanger rod or bar 16 especially when heavy objects such as coats have been mounted on the coat hanger. The bead-like rollers 14 assist the hook portion of the hanger to roll easily along the clothes hanger rod 16 making it easy to move heavy clothing from one place to another along the rod. The rotation of the rollers 14 is shown by arrows 36. The hanger 12 can be of a conventional shape or other shapes suitable for hanging garments thereon.

I claim:

1. A clothes hanger for being hung on a clothes hanging rod, comprising:

a) a clothes hanger, said clothes hanger having an upper hook portion for placement onto the rod and a lower portion for receiving clothes thereon, said hanger further comprising a shank portion for attaching said upper hook portion to said lower portion;

b) a plurality of rollers disposed on and substantially filling said upper hook portion for rolling said clothes hanger along said rod without dragging, said rollers each having a throughbore therein, said throughbore receiving said upper hook portion of the clothes hanger therein so that the rollers rotate on the upper hook portion, whereby the hook portion moves easily longitudinally along the clothes hanging rod due to the rotation of the plurality of rollers around the upper hook portion; and, c) a distal end of said hook portion being bent back onto itself to form a first roller stop and said shank portion being enlarged to form a second roller stop for keeping said rollers on said upper hook portion.

2. The clothes hanger of claim 1, wherein said rollers are substantially cylindrically shaped so that the rollers rotate on the upper hook portion.

3. The clothes hanger of claim 2, wherein said shank of said clothes hanger comprises a wire wrapping portion wherein the clothes hanger is wrapped upon itself to form the clothes hanger.

4. The clothes hanger of claim 3, wherein said second roller stop comprises a wire wrapping disposed on the shank portion of the clothes hanger.

* * * * *